United States Patent [19]

Van Doorn et al.

[11] 4,369,681

[45] Jan. 25, 1983

[54] INSIDE-OUT CUTTER FOR ELONGATED MATERIAL SUCH AS TOW

[75] Inventors: Donald W. Van Doorn; James B. Hawkins, both of Columbus, Ga.

[73] Assignee: Lummus Industries, Inc., Columbus, Ga.

[21] Appl. No.: 208,160

[22] Filed: Nov. 19, 1980

[51] Int. Cl.[3] ..... D10G 1/04; D10G 1/00

[52] U.S. Cl. ..... 83/100; 83/346; 83/564; 83/913

[58] Field of Search ..... 83/100, 37, 346, 347, 83/403, 913, 564

[56] References Cited

U.S. PATENT DOCUMENTS 3,861,257 1/1975 Laird et al. ..... 83/913 X 3,948,127 4/1976 Vehling et al. ..... 83/913 X 3,978,751 9/1976 Farmer et al. ..... 83/403

*Primary Examiner*—James M. Meister

*Attorney, Agent, or Firm*—Hugh P. Carter

[57] ABSTRACT

An inside-out cutter for material such as tow in which there is a single pressure roller, which roller has an outside diameter larger than one-half the inside diameter described by the cutting edges of the blades. The large diameter of such roller provides a gradual rather than an abrupt entrance-way for the fiber between the roller and the blades. The apparatus further is constructed to permit the movement of the pressure roller to be moved from a fiber cutting relation to the blades to a more centered position for removal of the roller from the apparatus, as when changing blades or the like.

17 Claims, 4 Drawing Figures

INSIDE-OUT CUTTER FOR ELONGATED MATERIAL SUCH AS TOW

Our invention relates to apparatus for cutting continuous strands of material such as tow into shorter lengths for use in textile operations.

The art of cutting elongated fibrous material such as man-made tow into shorter lengths for the textile industry was revolutionized some ten years ago. In the Garland B. Keith U.S. Pat. No. 3,485,120, there was disclosed for the first time so far as we know a practical, efficient and indeed, revolutionary, apparatus for cutting tow. The Keith apparatus is what is known as an outside-in tow cutter, namely the tow to be cut is wound on the surface of a reel and the outer layer of such tow is cut by being forced into cutting contact with a plurality of blades spaced apart the desired length of the tow cuttings. The assignee of this application has produced and sold commercially hundreds of such machines and they are being used worldwide for the purpose mentioned.

Another form of tow cutter also is basically known. This form of apparatus is known as the inside-out cutter, namely, apparatus in which the tow is fed in spirally wrapped layers to the inner surface of a knife equipped reel. The tow is pushed radially outwardly by means of a plurality of rollers placed inwardly of the spirally wound band of tow, causing the outer band or wrapping to be cut by the knives as the device operates.

In attempting to improve upon the inside-out type of cutter and thereby to reduce certain deficiencies in the present ones, we have devised the apparatus to be disclosed herein which in fact eliminates many of the problems with previous inside-out tow cutters. In addition, our improved apparatus is an improvement in many respects upon the outside-in tow cutter, particularly with regard to the elimination of the adverse effect of centrifugal force on the outside-in type apparatus. For instance, in the outside-in type device centrifugal force becomes a factor which impedes the flow of the cut staple inwardly from the cutting edges of the blades. Also, in cutting very short staples with the Kiete type apparatus the blade convergence and support members limit the minimum staple length that can be cut.

In the present type of inside-out cutters known to us the feeding of the uncut tow band into the inside of the cutting edges of the blades has created problems. For instance, where stationary surfaces have been used to direct the tow against the blades, friction has caused heat build-up. Where a number of rollers have been used the tow tends to take a chordal configuration and the layers of tow tend to shift in and out of the cutting edges of the blades, thus shaving very short increments of fiber from the already cut sections of tow. This creates fiber waste in the form of dust that is a nuisance in processing, wastes tow and adds unusuable weight to the bale of fiber, in turn adding to the shipping and storage costs. Since the long ends of the double-cut fibers are shortened, fiber length and uniformity thus is decreased. Furthermore, the pressure rollers used with present inside-out cutters have a tendency to accumulate filaments around their edges, requiring periodic removal, resulting in lost production.

In addition, as cutting speed increases, the use of several small pressure rollers results in a high impact cutting action due to the sudden convergence of the surface of the rollers and the cutting edges of the blades.

In view of the foregoing a primary object of our invention is to provide an improved inside-out cutter for tow and the like which shall, in most regards, eliminate the problems just mentioned, thus resulting in an improved apparatus which cuts tow uniformly, with minimum heat build-up, without shaving the ends of the already cut filaments or lengths and which at the same time is so constructed that the various parts may readily be disassembled for the purpose of repair, replacing blades, inspection, etc.

Specifically, we propose an inside-out tow cutter in which there is a single pressure roller which is, as nearly as possible, equal in diameter to the inside diameter described by the cutting edges of the blades. In other words, we propose a cutter of the character designated in which the pressure roller itself has an outside diameter larger than one-half the inside diameter described by the cutting edges of the blades.

Another object is to so construct the apparatus that negative air pressure may be maintained between the working arc of the pressure roller and the blades relative to the atmosphere inside the periphery of the pressure roller so that the fiber tends to be blown away from the surface and edges of the pressure roller thus causing the fibers to lay properly, for cutting, against the cutting edges of the blades.

Another object of our invention is to provide a tow cutter of the character designated in which the feeding of the uncut tow strand to the apparatus is through an elongated tube whereby the tow itself provides a sort of "seal" thereby permitting the maintenance of sufficient negative pressure in the cutting area as just mentioned.

Further objects of our invention are related to the details of construction which, collectively, provide fiber control around the flat surfaces of the pressure roller while at the same time permitting the roller to be moved into fiber cutting relation to the blades and permit the same to be moved to a more centered position relative to the parts as a whole, for removal, as when changing blades and the like.

Apparatus illustrating features of our invention is shown in the accompanying drawings forming a part of this application in which.

and

Figure 2:
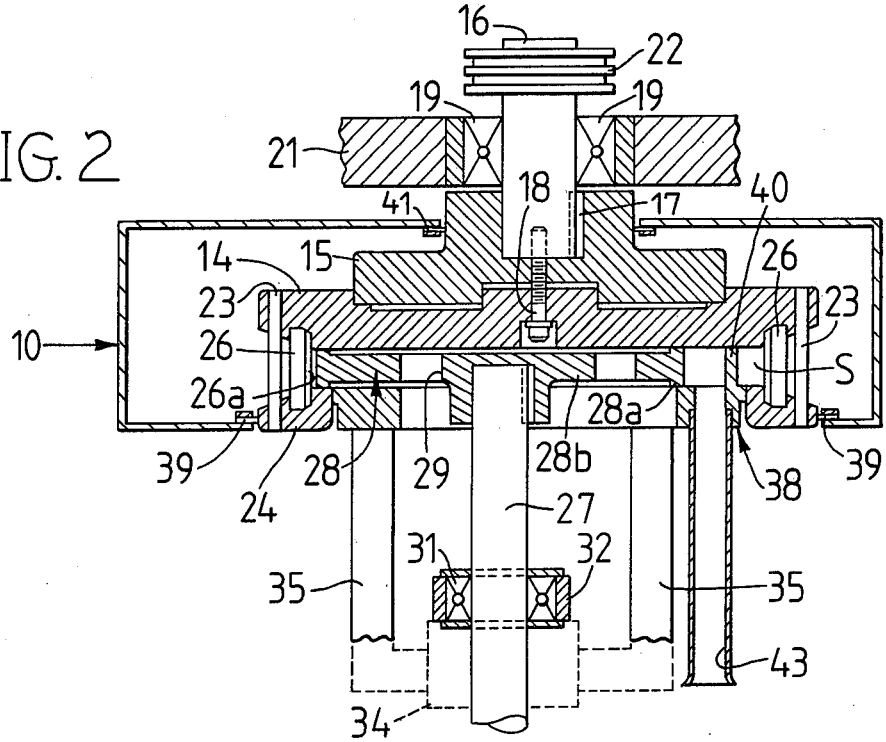
FIG. 2 is a detail sectional view taken generally along line 2—2 of FIG. 1.
Figure 4:
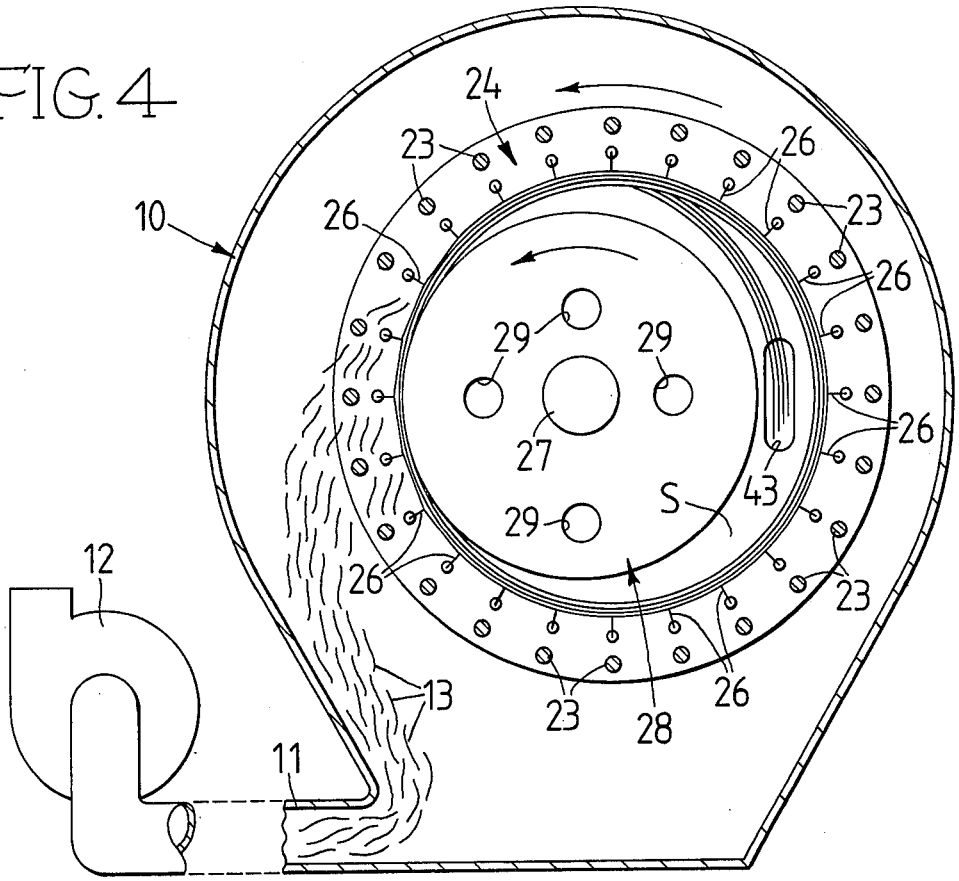

FIG. 4 is a view generally corresponding to FIG. 2 but on an enlarged scale and taken through the apparatus.

Referring now to the drawings for a better understanding of our invention, the outer part of the revolving apparatus may be enclosed in a substantially airtight housing indicated generally by the numeral 10. This housing 10 has an outlet 11 and to this is connected a suction fan 12. As will appear as the description proceeds, the fan 12 maintains a sub-atmospheric pressure within the housing and hence in certain critical spaces to be mentioned, while at the same time serving to discharge the cut lengths of tow from the apparatus, these being indicated in FIG. 4 by the numeral 13.

Figure 3:
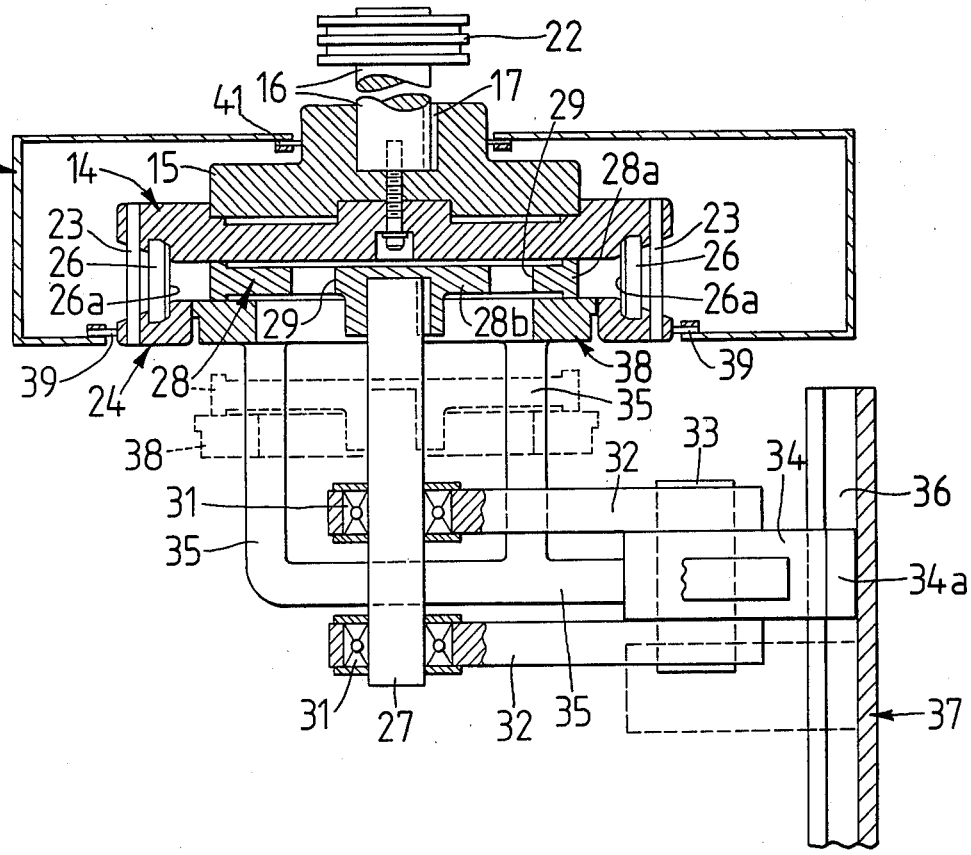
FIG. 3 is an enlarged detail sectional view, somewhat diagrammatic, taken generally along line 3—3 of FIG. 1, the dotted lines illustrating the position of the pressure roller and one of the sealing plates therefor in the retracted position.

As best illustrated in FIGS. 2 and 3 the main cutting wheel or reel for our improved apparatus is made up of a heavy disc 14 mounted in rigid, accurate fitting manner to the end of a shaft 16, as for instance, by means of a hub 15, a key 17 and a stud 18. The shaft 16 is mounted in suitable bearings 19 carried in a frame member 21. The shaft 16 may be driven by a pulley 22 from a source of power, not shown.

The disc 14 is attached by a plurality of post members 23 to a ring member 24. The outside diameters of the main disc numbered 14 and the ring 24 are substantially equal. Mounted in suitable sockets between the members 14 and 24 is a plurality of cutting blades 26 with their cutting edges 26$^a$ turned inwardly.

Mounted on a shaft 27 in fixed manner is a pressure roller 28. As will be seen particularly from FIG. 4 of the drawings the pressure roller 28 is as large as possible, namely, at least larger than one-half the inside diameter described by the cutting edges 26$^a$ of the blades 26. The purpose of this will be later explained. It will further be noted that the pressure roller is provided with a rim section 28$^a$ which is axially longer than the width of the central section of the roller indicated at 28$^b$. Still further, there may be at least one, preferably a plurality, of holes 29 through the pressure roller 28, this hole or holes communicating to atmosphere for a purpose later to appear.

It will also be noted that the shaft 27, mounted in bearings 31, is, when the parts are in operating position in offset relation to the shaft 16. We provide for this offset relation by mounting the bearings 31 in the ends of arms 32. The other ends of the arms are pivoted on a pin 33 carried on a standard or extension 34. The extension 34 is provided with gibs 34$^a$ which slide in ways 36 provided in a frame member 37.

Mounted in suitable fashion to member 34 is a stationary ring 38. The outer perimeter or ring 38 fits with a close running fit against the inside of ring 24. Thus, and as already described, the shaft 16 is driven to rotate the reel 14-24 in the direction of the arrows shown in FIG. 4 while the ring 38 remains stationary. Pressure roller 28 is rotated by engagement with the layered fiber. Also, and as described above, it will be seen that, by moving the member 34 in the ways 36, the pressure roller 28 and the ring 38 may be withdrawn from the apparatus as shown by the dotted lines in FIG. 3.

At 39 we show a ring-like seal between the housing 10 and the outer periphery of the ring 24. A similar seal 41 is placed between the hub 15 carried by the end of shaft 16, to which hub and shaft 16 the main disc 14 is secured by the stud 18 and the key 17, as has been stated.

The stationary ring 38 may be provided with an opening to receive the inner end of a feed tube 43. The tube 43 may be elongated as shown in FIG. 4 in the direction of rotation of the disc 28 and blade carrying rings 14 and 24. The tow to be cut is fed into the tube, to take the position generally shown in FIG. 4. Referring again to the ring 38, it will be understood that this ring may be supported by arms 35 from the sliding mechanism consisting of the arms 32, so that shaft 27 rotates inside the same while permitting the ring 38 and the pressure roller 28 to be withdrawn as shown in dotted lines in FIG. 3. Ring member 38 may have extending from its inner surface a "C" shaped lip or projection 40 that may aid the holding of the tow outward against the cutting edges of the blades and assist in initial thread up.

From the foregoing description the operation of our improved apparatus together with the various advantages thereof may now be more fully explained and understood.

Figure 1:
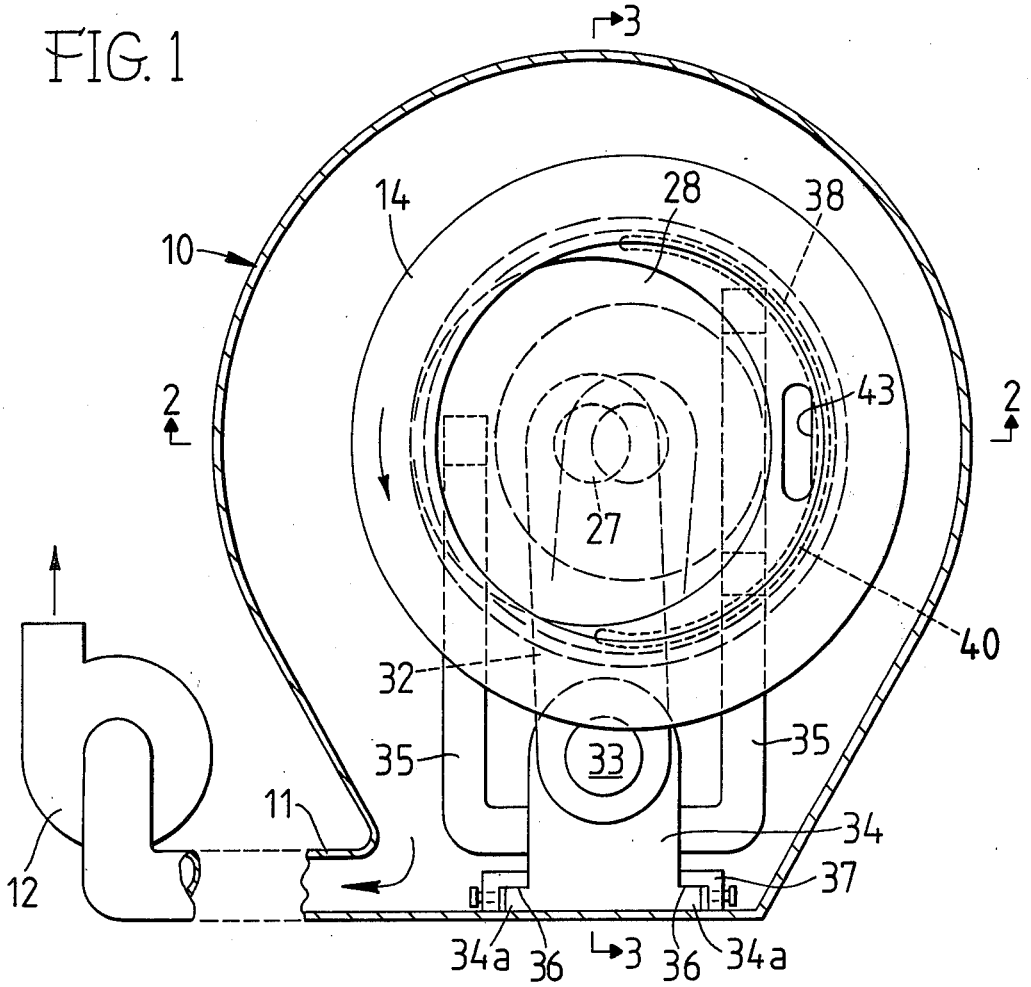
FIG. 1 is a somewhat diagrammatic plan view, partly in section and with certain parts broken away and illustrating our improved cutter with the pressure roll in fiber cutting position relative to the blades.

First, it will be seen that in order to withdraw the pressure roller 28 and the ring 38 from the apparatus, the parts must be moved to a position so that the shafts 16 and 27 are substantially aligned. If this were not so a portion of the periphery of the roller 28 would overlap the edge of the disc 24 and prevent its withdrawal. This movement is accomplished by the arrangement of the arms 32 and the pivot 33, this being shown in dotted lines in FIG. 1.

With the parts substantially centered, that is with the pressure roller arranged centrally of the apparatus, the suction fan 12 is started and shaft 16 is powered, rotating the reel. The pressure roller is now shifted from its center position to the left as viewed in FIG. 4. The end of the tow is now fed into the outer end of the tube 43. Due to the fact that negative pressure exists at the end of that tube, namely, in the space indicated by the letter S in the drawings, namely the space between the disc 14, periphery of roller 28 and rings 38 and 24, the tow is drawn inwardly. With the parts in operation, centrifugal force and air currents throw the tow outwardly against the cutting edges of the knives. As the layers of tow build up the pressure roller applies pressure on the innermost layer of the tow, forcing the outermost layer thereof into cutting engagement with the cutting edges of the knives 26 along the arc where the surface of the pressure roller comes closest to the cutting edges of the knives.

It will be noted that the angle at which the tow enters between the working arc of the roller 28 and the knives lying within that arc is a very gradual angle. This distinguishes our invention in one respect from the prior art devices which use a plurality of small diameter rollers corresponding to 28. In the case of the prior art with such smaller rollers the angle of entry of the fiber to be cut between the periphery of such roller and the blade is very abrupt. On the other hand, with the large diameter roller which we provide the angle of entry is very gradual and such gradual angle of convergence of the fibers into cutting position provides better cutting in the sense of reducing impact and reducing the cutting of short ends.

It will be noted, also, that the sub-atmospheric pressure above mentioned creates a controlled air flow and pressure differential to force the tow into several desirable actions. First, the tow is encouraged to lay snugly against the cutting edges of the blades once the tow enters the space S. As the tow first enters this space the air currents tend to direct the tow against the edges of the blades. Once the tow is fully layered around the blades, pressure differential developed due to the resistance of the air flow through the tow holds the tow snugly against the blade edges. Inasmuch as most tows have a crimp that tends to cause the tow to contract, and since the tow is now internally laid in a circle, the contraction tends to pull the tow away from the cutting edges. The pressure differential just mentioned overcomes this tendency, causing more accurate layering and hence more accurate cutting of the tow.

The elongated tube 43 provides a long, almost filled passageway through which the tow band must pass, thus restricting air flow through the hole into the space S and aids in maintaining a pressure differential and dynamic action along the tow in the tube, thus to pull the tow through the tube and into cutting position within the apparatus.

The pressure roller 28 is made to fit very snugly in the enlarged area section 28$^b$ thereof against the members 14 and 38. Even so, there is a tendency for stray fibers to work their way around the edges of the pressure roll 28. By admitting air from atmosphere through the hole or holes 29, a flow of air is induced radially outwardly of the pressure roller 28, thus to negative the tendency of fibers to flow radially inwardly, thus causing them to be forced back into the passage S for discharge.

In view of the foregoing it will be seen that we have devised an improved inside-out cutter for tow and the like. Our invention is characterized by the accuracy of cutting, a great reduction in friction and ease of manufacture, disassembly and blade replacement.

While we have shown our invention in but one form, it will be obvious to those skilled in the art that it is not so limited, but is susceptible of various changes and modifications without departing from the spirit thereof.

What we claim is:

1. In apparatus for cutting elongated fiber-like material into short lengths, (a) a, rotary reel carrying a plurality of spaced apart circularly arranged knives having inwardly directed cutting edges, (b) means to feed the material to be cut into overlapping layers with the outermost layer in contact with the cutting edges of the knives, and (c) a single pressure roller mounted for rotation in the same direction as the reel disposed for a portion of its periphery to contact a segment of the innermost of the layers and force the outermost ones thereof into cutting engagement with the knives adjacent said segment, the diameter of said pressure roller being equal at least to one-half the diameter of the circle inscribed by the cutting edges of said knives, whereby, in operation, there is substantially no circumferential slippage between the roller, the material being cut and the cutting edges of the blades.

2. In apparatus for cutting elongated fiber-like material into short lengths, (a) a driven rotary reel carrying a plurality of spaced apart circularly arranged knives having inwardly directed cutting edges, (b) means to feed the material to be cut into overlapping layers with the outermost layer in contact with the cutting edges of the knives, (c) a single pressure roller disposed to contact a segment of the innermost of the layers and force the outermost ones thereof into cutting engagement with the knives adjacent said segment, and (d) means mounting the pressure roller for radial movement from a working position located offset from the axial center of the reel to a non-working position nearer the axial center of the reel.

3. Apparatus as defined in claim 1 in which there is means to maintain the space between the periphery of the pressure roller and the layer of fibers lying against said knives under subatmospheric pressure.

4. Apparatus as defined in claim 1 in which there is means to maintain the space between the periphery of the pressure roller and the layer of fibers lying against said knives under a pressure lower than that inwardly of the periphery of the pressure roller.

5. Apparatus as defined in claim 2 in which there is means to maintain the space between the periphery of the pressure roller and the layer of fibers lying against said knives under subatmospheric pressure.

6. Apparatus as defined in claim 2 in which there is means to maintain the space between the periphery of the pressure roller and the layer of fibers lying against said knives under a pressure lower than that inwardly of the periphery of the pressure roller.

7. A cutter reel and pressure roller assembly for inside-out elongated fiber cutting apparatus comprising, (a) a cutter reel carrying a circularly arranged row of spaced apart knives with their cutting edges inwardly directed, (b) means to feed the fiber to be cut into superposed layers with the outermost layer lying in contact with the cutting edges of the knives, (c) a single pressure roller disposed for its periphery to contact the innermost layer of fibers and press a segment of the outermost layer thereof into cutting engagement with the knives, (d) means mounting the pressure roller for movement from a non-fiber cutting position adjacent the axial center of the knife circle to a working position more radially offset therefrom, and (e) means mounting the pressure roller for movement axially of the knife circle, said means just named being operative when said roller center is adjacent the axial position with respect to the knife circle.

8. Apparatus as defined in claim 7 in which the means mounting the pressure roller for movement axially of the knife circle includes means associated therewith to make said means inoperative when said roller is in the radially offset position.

9. Apparatus as defined in claim 7 in which the means to feed fiber into the apparatus directs the same at least partially axially thereinto relative to the knife circle and is located at a position diametrically opposite the segment of the superposed layers which is engaged by the pressure roller when in cutting position.

10. A cutter reel and pressure roller assembly for inside-out elongated fiber cutting apparatus comprising:

(a) a cutter reel comprising in part a main plate and a ring axially spaced therefrom, (b) a plurality of circularly arranged spaced apart knives carried between the main plate and the ring, the cutting edges of said knives being directed inwardly, (c) a stationary ring-like plate the periphery of which fits with a close running fit into the ring plate of the reel and is spaced from the main plate to provide a cavity for a pressure roller, the outer periphery of said cavity being bounded by the periphery of a pressure roller, the cutting edges of the blades, a surface of said ring-like plate and surfaces of the cutter reel parts, (d) a pressure roller mounted in said cavity, (e) means to feed the fiber to be cut into overlapping superposed layers with the outermost layer lying in contact with the cutting edges of the knives and with the periphery of the pressure roller in contact with a segment of the innermost layer, thus to force the outermost layer into cutting engagement with the knives, (f) means to feed the fiber to be cut through the stationary ring-like plate and into said cavity, (g) means to rotate the knife carrying reel and the pressure roller in the same direction and at substantially the same peripheral speed of knife cutting edges and pressure roller surface, and (h) means to maintain the outer periphery of said cavity under negative atmospheric pressure while the apparatus is cutting fiber.

11. A cutter reel and pressure roller assembly for inside-out elongated fiber cutting apparatus comprising:

(a) a cutter reel comprising in part a main plate and a ring axially spaced therefrom, (b) a plurality of circularly arranged spaced apart knives carried between the main plate and the ring, the cutting edges of said knives being directed inwardly, (c) a stationary ring-like plate the periphery of which fits with a close running fit into the ring plate of the reel and is spaced from the main plate to provide a cavity for a pressure roller, (d) a pressure roller mounted in said cavity, (e) means to feed the fiber to be cut into overlapping superposed layers with the outermost layer lying in contact with the cutting edges of the knives and with the periphery of the pressure roller in contact with a segment of the innermost layer, thus to force the outermost layer into cutting engagement with the knives, (f) means to feed the fiber to be cut through the stationary ring-like plate and into said cavity, (g) means to rotate the knife carrying reel and the pressure roller in the same direction and at substantially the same peripheral speed of knife cutting edges and pressure roller surface, and (h) means to maintain said cavity at a lower pressure than exists in the space inside the ring-like plate.

12. A cutter reel and pressure roller assembly for inside-out elongated fiber cutting apparatus comprising:

(a) a cutter reel comprising in part a main plate and a ring axially spaced therefrom, (b) a plurality of circularly arranged spaced apart knives carried between the main plate and the ring, the cutting edges of said knives being directed inwardly, (c) a stationary ring-like plate the periphery of which fits with a close running fit into the ring plate of the reel and is spaced from the main plate to provide a cavity for a pressure roller, (d) a pressure roller mounted in said cavity, (e) means to feed the fiber to be cut into overlapping superposed layers with the outermost layer lying in contact with the cutting edges of the knives and with the periphery of the pressure roller in contact with a segment of the innermost layer, thus to force the outermost layer into cutting engagement with the knives, (f) means to feed the fiber to be cut through the stationary ring-like plate and into said cavity, (g) means to rotate the knife carrying reel and the pressure roller in the same direction and at substantially the same peripheral speed of knife cutting edges and pressure roller surface, and (h) means to maintain the portion of said cavity between the periphery of the roller and the cutting edges of the knives at a pressure lower than exists in the space inside the ring-like plate, but higher than the pressure in the space outside said cutting knives.

13. Apparatus as defined in claim 10 in which the pressure roller and said stationary ring-like plate are mounted for axial movement relative to the knife circle, whereby both of the same may be withdrawn from the apparatus.

14. Apparatus as defined in claim 10 in which there is means mounting the pressure roller for movement from a non-fiber cutting position adjacent the axial center of the knife circle to a working position more radially offset therefrom.

15. Apparatus as defined in claim 10 in which there is means to vent the sides and/or outer face of the pressure roller to atmosphere while maintaining said space under sub-atmospheric pressure.

16. Apparatus as defined in claim 10 in which there is means to vent the sides or outer face of the pressure roller to the higher pressure in the space inside the ring-like plate while maintaining said space outside the periphery of the pressure roller at the lower pressure.

17. Apparatus as defined in claim 10 in which said stationary ring-like plate has projecting axially from its inner face a fin which generally follows the contour of the outer surface of said ring-like plate and covers approximately half of its circumference, thus to form a C-shaped surface to direct and support the layers of fiber against the cutting edges of the knives around the circumference where the pressure roller is not in close relationship to the cutting edges of the knives.

* * * * *